United States Patent [19]

Enoguchi et al.

[11] Patent Number: 5,035,197

[45] Date of Patent: Jul. 30, 1991

[54] DEVELOPING DEVICE

[75] Inventors: Yuji Enoguchi; Toshiya Natsuhara; Hiroshi Mizuno, all of Osaka, Japan

[73] Assignee: Minolta Camera Kabushiki Kaisha, Osaka, Japan

[21] Appl. No.: 379,554

[22] Filed: Jul. 13, 1989

[30] Foreign Application Priority Data

Jul. 14, 1988 [JP] Japan ..... 63-176155
Aug. 1, 1988 [JP] Japan ..... 63-192390

[51] Int. Cl.[5] ..... G03G 15/06
[52] U.S. Cl. ..... 118/647; 355/245
[58] Field of Search ..... 355/259, 245, 261, 262, 355/263; 118/653, 647, 648, 649, 644

[56] References Cited

U.S. PATENT DOCUMENTS

| | | | |
|---|---|---|---|
| 4,445,771 | 5/1984 | Sakamoto et al. | 355/253 |
| 4,564,285 | 1/1986 | Yasuda et al. | 118/651 |
| 4,575,218 | 3/1986 | Sakamoto et al. | 355/251 |
| 4,576,463 | 3/1986 | Sakamoto et al. | 355/253 |
| 4,656,964 | 4/1987 | Kanno et al. | 118/653 X |
| 4,791,882 | 12/1988 | Enoguchi et al. | 355/259 X |

FOREIGN PATENT DOCUMENTS 58-211172 6/1982 Japan .

*Primary Examiner*—A. T. Grimley
*Assistant Examiner*—Sandra L. Hoffman
*Attorney, Agent, or Firm*—Burns, Doane, Swecker & Mathis

[57] ABSTRACT

The present invention discloses a monocomponent developing device which comprises an image carrying member having an electrostatic latent image formed on its surface, a rotatably disposed actuating roller confronting said image carrying member, a toner transporting member formed of flexible member having a peripheral length longer than that of said actuating roller and loosely mounted thereover, said toner transporting member being an endless thin film member constructed of anisotropic electrically conductive film alternatively comprising insulated portions and electrically conductive portions which are formed by a plurality of electrodes so as to be conductive in the film width direction, and positioning means for positioning said toner transporting member in order to form a slack in the toner transporting member at a location confronting said image carrying member and bringing the slack into contact with the image carrying member.

7 Claims, 4 Drawing Sheets

DEVELOPING DEVICE

BACKGROUND OF THE INVENTION

1. Field of the Invention

The present invention relates to a developing device that supplies toner from a toner transport member to the surface of an image carrier member having electrostatic latent image formed thereon so as to develop said image with said toner, and more specifically relates to a monocomponent type developing device using a monocomponent developing material.

2. Description of the Prior Art

Conventionally, various types cf developing devices which supply toner to an electrostatic latent image formed on the surface of an image carrier member have been used in electrophotographic copying machines and the like.

Developing device used in electrophotographic copying machines require different developing characteristics depending on whether the original document image consists of a line image or solid image. That is, when the original document image is a solid image, copy image density must be obtained which corresponds to the density of the original document image, whereas when the original image is a line image, the density of the copy image must be higher than that of the original document image density.

In accordance with the aforesaid requirements, two-component type developing devices which use a two-component developing material comprising a toner and a carrier produce a so-called edge effect in line images due to the action of the carrier contained in the developing material, and the copy image density rises rapidly relative to the original document image density, and produces a high copy image density even when the original document image density is low and, when used for solid images, produces a copy image density which corresponds to the original document image density.

However, problems such as image variability and the like occur when using the aforesaid type of two-component developing device due to carrier deterioration and variance in the toner/carrier mixing ratio.

On the other hand, monocomponent developing devices, which use a toner alone as the developing material in a contact type developing method employing a conductive roller or conductive flexible sleeve, produce excellent $\gamma$-characteristics and rapid rise in copy image density relative to the original document image density.

Thus, the aforesaid monocomponent type of developing device is suitable for digital image reproduction used by printers and the like, but has poor reproducibility when multistage density gradation is required for digital color images and tone reproduction in copier images.

The previously described monocomponent developing device has been thoroughly investigated and produces a copy image density that corresponds to the original document image density for solid images, and rapidly increases copy image density when the original document image density is low for line images so as to produce a high density copy image.

Japanese Patent Application No. 57-114163 discloses an electrically insulated conductive substrate together with a mutually insulated microelectrodes that are electrically insulated from said substrate by means of an insulating material on said substrate member used as a toner transporting member in the previously described monocomponent type of developing device.

When the aforesaid type of toner transporting member is used, the microelectrodes perform the same role as the carrier in the previously described two-component developing material through the insulating material on the electrically conductive substrate so as to produce the same developing characteristics as the aforesaid two-component type developing device.

However, in developing devices using the aforesaid toner transporting member, the electric lines of force from the electrostatic latent image toward to the electrically conductive substrate are regulated by the thickness and permittivity of the insulating material provided on the conductive substrate of the toner transporting member so as to thereby determine the edge effect, tone and like image characteristics. Although these properties must be regulated to correspond to solid or line original document images to produce suitable edge effect and tone, it is extremely difficult to regulate the aforesaid image characteristics such as edge effect and tone by changing the characteristics of this type of toner transporting member.

In this type of developing device, a means for suitably altering developing characteristics is disclosed in U.S. patent application No. 4564285, wherein is described a layer of electrically insulating material supporting microelectrodes disposed on an electrically conductive layer, or a dielectric layer provided beneath an electrically conductive layer such that the developing characteristics may be changed by applying a bias voltage to either electrically conductive layer.

However, this type of multilayered toner transporting member is very difficult to manufacture, and problems arise from the use of the method of applying a bias voltage to the conductive layer disposed between the dielectric layer and the insulating layer containing the microelectrodes.

Further, the previously mentioned toner transporting member disclosed in Japanese Patent Application No. 57-114163 provides microelectrodes in an insulating material on an electrically conductive substrate, and because the surface of the insulating material loses suppleness and hardens, sufficient adhesion is not obtained during contact between the insulating surface and the hard image carrier such as a photoconductive drum, and the surface of said image carrier may be damaged by such contact, thereby reducing image quality.

When toner is supplied from the aforesaid toner transporting member to the surface of the image carrier, a charge remains on the microelectrodes requiring the use of a discharging means to eliminate said residual charge, and if said residual charge is not sufficiently discharged it accumulates and reduces image quality.

In recent years, therefore, construction of the insulation material supporting the microelectrodes using photoconductive material which is electrically conductive only when exposed to light has been proposed together with the use of an eraser lamp as a discharging means so as to sufficiently discharge the residual charge from the microelectrodes, as disclosed in Japanese Patent Application No. 58-211172.

In the aforesaid construction, however, construction costs are increased and manufacturing is complicated by the need to use special photoconductive material in the insulating material which contains the microelectrodes.

SUMMARY OF THE INVENTION

A main object of the present invention is to provide simple and low-cost monocomponent developing device which allows line and solid image reproduction to be readily controllable.

Another object of the present invention is to provide a monocomponent developing device which uses a simple toner transporting member constructed so as to provide superior adhesion during contact with the image carrying member without causing damage to said image carrying member, and which allows ready image control in terms of edge effect and tone.

A further object of the present invention is to provide a developing device which allows easy discharging of the charge accumulated by &he toner transporting member after toner has been supplied.

These and other objects of the present invention are accomplished by providing a monocomponent developing device having an image carrying member which has an electrostatic latent image formed on its surface;

a toner transporting member which supplies toner to the surface of a latent image carrying member, said toner transporting member being an endless thin film member constructed of anisotropic electrically conductive film comprising an insulated portion and an electrically conductive portion conductive in the film width direction;

and an actuating roller for driving the aforesaid toner transporting member;

said monocomponent developing device being characterized in that the aforesaid actuating roller is out of contact with said toner transporting member portion between the toner transporting member and the image carrying member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

A first embodiment of the present invention is hereinafter described in detail with reference to the accompanying drawings.

Figure 1:
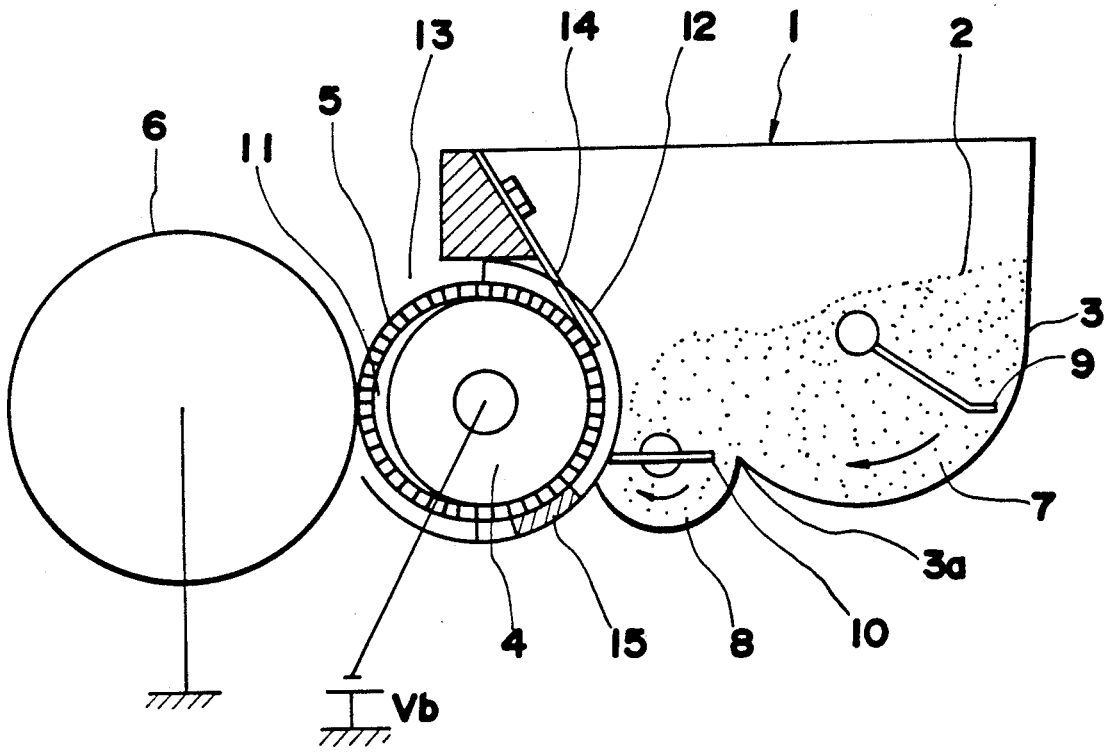
FIG. 1 is a brief section view showing a first embodiment of the developing device of the present invention supplying toner to the surface of a photoconductive drum.
Figure 2:
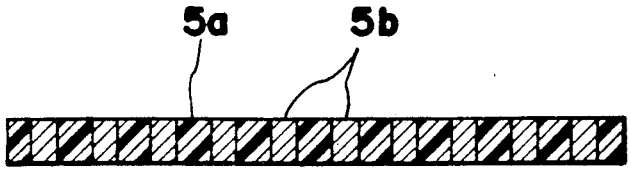
FIG. 2 is a section view of anisotropic conductive film used in the toner transporting member of the first embodiment of the present invention.

In developing device 1 of the first embodiment, only toner 2 is used as the developing material and is accommodated in a developing tank 3, and said toner 2 is supplied to a toner transporting member 5 which is driven by an actuating roller 4, as shown in FIG. 1. The surface of a photoconductive drum 6, which acts as the image carrying member and is disposed in proximity to the developing device 1, is in contact with the aforesaid toner transporting member 5, so that the toner 2 that is transported by said toner transporting member 5 is supplied to the surface of the photoconductive drum 6 that has an electrostatic latent image formed thereon.

In developing device 1, a first mixing section 7 is provided at a position behind and separated from the photoconductive drum 6 in the developing tank 3 which accommodates toner 2, as shown in FIG. 1, and a second mixing section 8 is provided opposite the first mixing section 7 so as to confront the photoconductive drum 6.

The first and second mixing sections 7 and 8 are separated by a partition 3*a* provided at the bottom of developing tank 3. First mixing section 7 is provided a first mixing member 9 which rotates to mix the toner 2 and transport said toner 2 to the second mixing section 8. The second mixing section 8 is provided a second mixing member 10 which rotates to mix the toner 2 transported thereto by the first mixing member 9 and supply said toner 2 to the aforesaid toner transporting member 5.

The toner transporting member 5 which supplies toner 2 is constructed of anisotropic conductive film formed by passing a plurality of microelectrodes 5*b* made of an electrically conductive material such as carbon black through an endless dielectric member 5*a* comprised of polyimide or like insulting material so as to make said film conductive in the film width direction. The aforesaid anisotropic conductive film comprises an insulated dielectric film portion 5*a* and electrically conductive electrode portion 5*b* in mutual proximity, and has a diameter slightly longer than the major diameter of actuating roller 4.

Actuating roller 4 which drives the toner transporting member 5 comprises a cylindrically shaped electrically conductive member of aluminum or stainless steel or the like, or an electrically conductive layer superimposed on the outer surface of a cylindrical substrate, or an elastic conductive layer of rubber or the like is used, such that a bias voltage $V_b$ is applied to actuating roller 4 when toner 2 is supplied from toner transporting member 5 to the surface of photoconductive drum 6.

The exterior of actuating roller 4 is encircled by the endless toner transporting member 5, which has a diameter that is slightly greater than the major diameter of said actuating roller 4. In this state, actuating roller 4 is rotatably mounted in proximity to the opening 13 of developing device 1 so as to confront photoconductive drum 6, and is rotated by a motor not shown in the drawings.

An elastic pad 12 is provided which extends in the axial direction to both ends of toner transporting member 5 encircling actuating roller 4 except for that portion corresponding to the aforesaid opening 13, and toner transporting member 5 adheres to the exterior surface of actuating roller 4 except in the location of opening 13, such that said toner transporting member 5 is transported with the rotating of said actuating roller 4 by means of frictional force.

As a result of the aforesaid arrangement, the excess length of toner transporting member 5 extends forward of actuating roller 4 at opening 13 confronting the photoconductive drum 6 so that a space 11 is formed between toner transporting member 5 and actuating roller 4 at that location, and the extending portion of toner transporting member 5 makes contact with the surface of photoconductive drum 6.

In developing device 1, a blade 14 is mounted above the toner transporting member 5 that encircles actuating roller 4 as described above, said blade 14 makes pressure contact with toner transporting member 5 which adheres to actuating roller 4 so that the toner 2 that is deposited on the surface of said toner transporting member 5 is uniformly and thinly spread on the surface of said member 5 by the front edge of said blade 14 while said toner 2 is simultaneously triboelectrically charged by said blade 14.

A description follows hereinafter of how toner 2 is supplied to the surface of photoconductive drum 6 upon which is formed an electrostatic latent image using developing device 1.

First, toner 2 accommodated in developing tank 3 is mixed by first mixing member 9 in first mixing section 7, and supplied to second mixing section 8. Then, toner 2 which has been supplied to the second mixing section 8 is mixed by a mixing member 10 provided therein, and thereafter supplied to the surface of toner transporting member 5 which is driven by the previously mentioned actuating roller 4.

The toner 2 which has been supplied to the surface of toner transporting member 5 adheres to the surface thereof by means of contact with said toner transporting member 5 and electrostatic force. Toner 2 is transported in this state with said toner transporting member 5, and charged with a positive polarity in the present embodiment through the influence of friction produced between blade 14 and said toner transporting member 5.

The charged toner 2 is spread by blade 14 to thinly coat the toner transporting member 5, and when in this state the toner transporting member 5 extends forward from the opening 13 of developing device 1 and makes contact with the surface of photoconductive drum 6, the toner 2 which adheres to the surface of the toner transporting member 5 is supplied to the electrostatic latent image formed on the surface of said photoconductive drum 6 by means of voltage difference between the surface potential of said photoconductive drum 6 and the bias voltage $V_b$ applied to actuating roller 4, thereby forming a toner image on the surface of said photoconductive drum 6.

Figure 3:
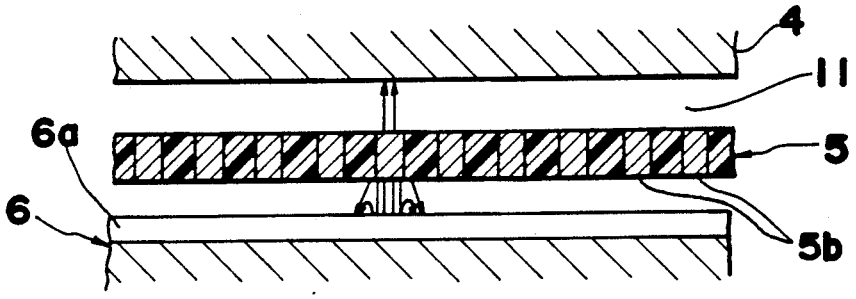
FIG. 3 is an illustration showing the state of the electrical lines of force in the case of a line image-type latent image when toner adheres to an electrostatic latent image formed on the surface of a photoconductive drum by the developing device of the first embodiment of the invention.

When the electrostatic latent image formed on the surface photosensitive layer **6*a* of drum 6 is a line image, a portion of the electrical lines of force emanating from the latent image location on the surface of photoconductive drum 6 passes through space 11 from electrodes 5*b* of toner transporting member 5 to confront the actuating roller 4, as shown in FIG. 3. At this time, the microelectrodes 5*b* contained in the toner transporting member 5 make contact with the surface of photoconductive drum 6 through the aforesaid space 11, so that said conductive microelectrodes 5*b* become electrically floated and perform the roll of the carrier in two-component developing material. The greater portion of the electrical lines of force therefore confront the edge portion of the latent image formed on the surface of photoconductive drum 6**, thereby producing a so-called edge effect to produce a high density copy image even when the original document image has a low density.

Figure 4:
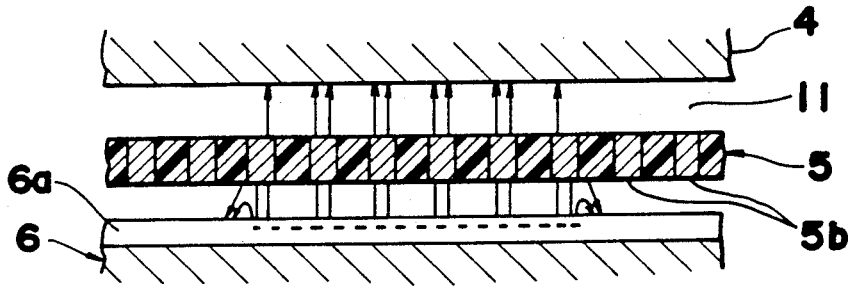
FIG. 4 is an illustration showing the state of the electrical lines of force in the case of a solid image-type latent image when toner adheres to an electrostatic latent image formed on the surface of a photoconductive drum by the developing device of the firs: embodiment of the invention.

When the electrostatic latent image formed on the photosensitive layer **6*a* of drum 6 is a solid image, the electrical lines of force emanate from the center of the latent image and not the edges and pass through space 11 from electrodes 5*b* of toner transporting member 5 to confront the actuating roller 4, as shown in FIG. 4. These lines of electrical force toward actuating roller 4 are less than the lines of force between the conductive electrodes and actuating roller when space 11 is omitted and are longer only by the distance of said space 11**, thereby producing a copy image density that corresponds to the image density of the original document.

In the present embodiment, the gap of space 11 disposed between the toner transporting member 5 and the actuating roller 4 is set to produce the previously described edge effect and tone reproduction, and although set to correspond to an analog image, the aforesaid gap of space 11 may be changed to adjust the edge effect and tone reproduction to obtain remarkable digital developing characteristics for $\gamma$ characteristics corresponding to a digital image produced by a laser printer.

In the portion wherein toner transporting member 5 makes contact with photoconductive drum 6, the toner transporting member 5 makes uniformly soft contact with the surface of said photoconductive drum 6 with a suitable nip width because toner transporting member 5 extends forward from said actuating roller 4 at the opening 13 and has a space 11 disposed therebetween so as to uniformly supply toner 2 to the surface of photoconductive drum 6 without damaging the surface of said drum.

Thus, when toner 2 is supplied to photoconductive drum 6 from toner transporting member 5, the electrodes **5*b* of toner transporting member 5 retain a charge of the opposite polarity to that of toner 2, but when in this state toner transporting member 5 is driven by actuating roller 4 to be guided from opening 13 into the developing device 1 and makes contact with actuating roller 4, the residual charges on electrodes 5*b* pass said actuating roller 4** and are discharged therefrom.

Thereafter, toner transporting member 5 is driven by actuating roller 4 while it is in contact with said roller 4, and toner 2 is uniformly spread on the surface of toner transporting member 5 by pad 15, after which said toner 2 is supplied again to the second mixing section 8.

The aforesaid operation is repeated, so as to continually supply toner 2 to the electrostatic latent image formed on the surface of photoconductive drum 6.

Figure 5:
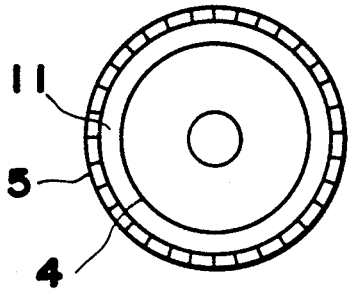
FIG. 5 shows a modified embodiment when the toner transporting member of the first embodiment of the invention is provided on the outside of an actuating roller.

Although in the aforesaid embodiment of developing device 1, the toner transporting member 5 and actuating roller 4 form a space 11 therebetween only in the vicinity of opening 13 opposite photoconductive member 6, said toner transporting member 5 and actuating roller 4 may be partially connected at either end so as to form a space 11 between the toner transporting member 5 and the entire periphery of actuating roller 4, as shown in FIG. 5. In such a case, a discharging means is provided to discharge the residual charge retained by the electrodes **5*b* of toner transporting member 5**.

In the developing device of the present invention as described herein above, the toner transporting member supplies toner to the surface of an image carrying member bearing an electrostatic latent image and is constructed of an anisotropic conductive film. The electrodes of the anisotropic conductive film performs the role of the carrier in two-component developing material, and a space is provided between the toner transporting member and the actuating roller in the section wherein said toner transporting member makes contact with the image carrying member and said space is used as a dielectric layer so that by adjusting the distance of said space, the electrical lines of force from the electrostatic latent image portion to the actuating roller may be controlled.

The aforesaid arrangement in the developing device of the present invention provides for the production of a high density copy image of a low density original document line image on the one hand, and production of a copy image density which corresponds to the density of an original document solid image on the other hand just as in two-component developing devices by merely adjusting the distance of the space between the toner transporting member and the actuating roller. Further, the copy image density rapidly increases relative to the original document image density and remarkable digital developing characteristics for $\gamma$-characteristics can be obtained to simply control the image edge effect and tone.

In the previously described portion of the developing device wherein the toner transporting member and image carrying member make contact, a space is provided between the toner transporting member and actuating roller so that said toner transporting member extends forward from the actuating roller to make contact with the image carrying member, so as to allow a high degree of adhesion of the toner transporting member to the image carrying member without damaging said image carrying member and produce a stable, uniform image.

In addition, when the toner transporting member comes into contact with the actuating roller after contacting the image carrying member and supplying toner, the residual charge retained by the electrodes of the toner transporting member are discharged as said electrodes pass the actuating roller, thus rendering the separate discharging means of conventional devices unnecessary, reducing manufacturing costs and making the device itself more compact.

A second embodiment of the present invention is described in detail hereinafter with reference to the accompanying drawings.

Figure 6:
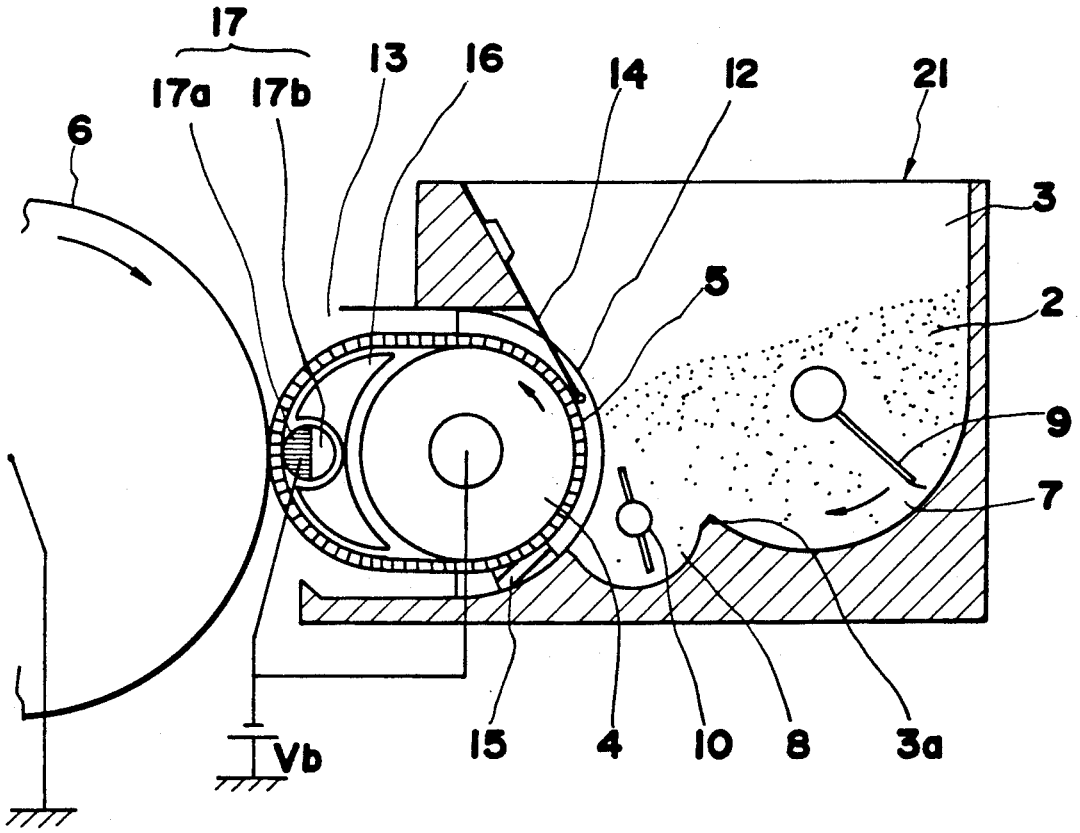
FIG. 6 is a brief section view showing a second embodiment of the developing device of the present invention supplying toner to the surface of a photoconductive drum.
Figure 7:
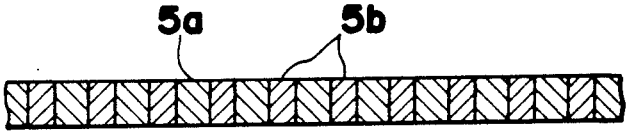
FIG. 7 is a section view of an anisotropic conductive film used in the toner transporting member of the second embodiment of the present invention.

A switching means 17 disposed so as to make contact with the interior surface of the toner transporting member 5 is a characteristic of the second embodiment. As shown in FIG. 6, switching means 17 is disposed so as to encircled by toner transporting member 5 in a position wherein the toner transporting member 5 is in contact with the surface of photoconductive drum 6, said switching means 17 being formed in a circular shape comprising a semicircular conductive portion **17*a* and a semicircular nonconductive portion 17*b*. Switching means 17 rotates in the circumferential direction in accordance with the various types of input image data so as to switch between the conductive portion 17*a* and nonconductive portion 17*b* to make contact with the inside of toner transporting member 5. A bias voltage $V_b$ is applied to the conductive portion 17*a* of switching means 17 and the previously mentioned actuating roller 4**.

The second embodiment of the present invention is constructed in substantially the same manner as the first embodiment, with the exception that the switching means 17 is provided and disposed to make contact with the interior surface of the toner transporting member 5 and confront photoconductive drum 6.

A description follows hereinafter of how toner 2 is supplied to the surface of photoconductive drum 6 upon which is formed an electrostatic latent image using developing device 21 of the second embodiment of the present invention. Toner 2 accommodated in the developing tank 3 adheres to the surface of the toner transporting member 5 by electrostatic force and is spread uniformly on the surface of said toner transporting member 5 by pressure contact of a blade 14, said toner 2 is triboelectrically charged with a positive polarity through contact with said blade 14, and thereafter supplied to the surface of photoconductive drum 6 so as to form a toner image thereon; the aforesaid process is identical to that described for the first embodiment.

When the conductive portion **17*a* of switching means 17 is disposed so as to make contact with the inside surface of toner transporting member 5 at the position wherein said toner transporting member 5 confronts photoconductive drum 6, the lines of electric force emanating from the latent image formed on the surface of photoconductive drum 6 pass through the anisotropic conductive layer formed on toner transporting member 5 toward the aforesaid conductive portion 17*a***, rapidly increasing the copy image density relative to the density of the original document image, thereby producing remarkable digital developing characteristics for $\gamma$ characteristics so as to suitably reproduce the digital image on a laser printer or the like.

On the other hand, when switching means 17 is rotated from the above described state so that the nonconductive portion **17*b* of switching means 17 is in contact with the interior surface of toner transporting member 5, the nonconductive portion 17*b* is interposed between the toner transporting member 5 and conductive portion 17*a*, and the microelectrodes 5*b* which are provided in the anisotropic conductive layer of toner transporting member 5 are electrically floated from conductive portion 17*a*** and perform the role of the carrier in two-component developing material.

Figure 8:
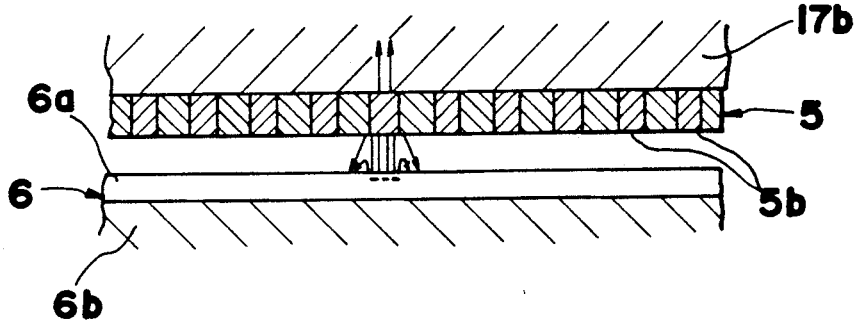
FIG. 8(A) is an illustration showing the state of the electrical lines of force in the case of a line image-type latent image when a nonconductive portion of a switching means is confronted with the interior of the toner transporting member in the developing device of the second embodiment.
FIG. 8(B) is an illustration showing the state of the electrical lines of force in the case of a solid image type latent image when a nonconductive portion of a switching means is confronted with the interior of the toner transporting member in the developing device of the second embodiment.
Figure 8:
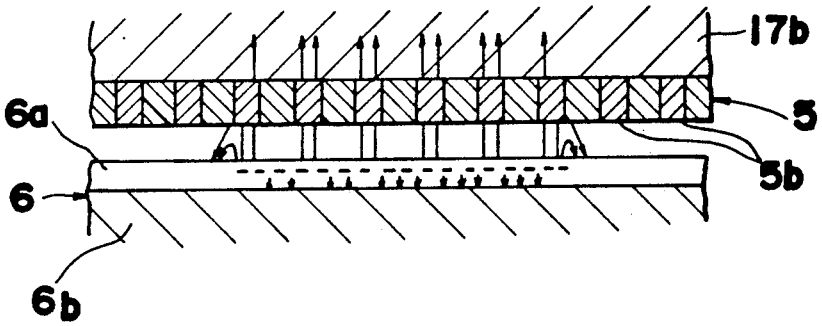

Accordingly, when the nonconductive portion **17*b* of switching means 17 is in contact with the inside of toner transporting member 5 and the latent image formed on the photosensitive surface 6*a* of photoconductive drum 6 is a line image, the majority of the electrical lines of force emanating from the latent image return to the vicinity of the edge of said latent image through the action of the microelectrodes 5b provided in the anisotropic conductive film, as shown in FIG. 8A**, thereby producing an edge effect and rapidly increasing the copy image density so as to produce a high density copy image even when the original document image has a low density.

When the latent image formed on the photosensitive layer 6a on the surface of photoconductive drum 6 is a solid image, the electrical lines of force emanating from the center of the latent image pass through the electrodes 5b of toner transporting member 5 and the nonconductive portion 17b of switching means 17 toward the conductive portion 17a as well as toward the substrate 6b of photoconductive drum 6, as shown in FIG. 8B, because the distance from the center of the latent image to the surface of photoconductive drum 6 is lengthened, thereby producing a copy image density corresponding to the original document image density.

Thus, when charged toner 2 is supplied from the toner transporting member 5 to a latent image on the surface of photoconductive drum 6, a charge with a polarity opposite that of the charged toner 2 is retained by electrodes 5b of transporting member 5. Thereafter, toner transporting member 5 is rotated by actuating roller 4 until inside developing device 21 from the opening 13, whereupon the electrodes 5b come into contact with the aforesaid actuating roller 4 which is constructed of conductive material, and the residual charge retained by the electrodes 5b is discharged through the aforesaid actuating roller 4.

Even after the residual charge retained by the electrodes 5b of toner transporting member 5 is thus discharged, the toner transporting member 5 is driven by actuating roller 4 while it is in contact with said roller 4, and toner 2 on the surface of transporting member 5 is spread uniformly thereon by spreading pad 15 and toner 2 is again supplied from the second mixing section 8.

The aforesaid operation is repeated so as to continuously supply toner 2 to the electrostatic latent image formed on the surface of photoconductive drum 6.

Although, in the second embodiment, the device of the present invention has been described as being formed by an anisotropic conductive film, a resistive member may be used which is formed in a circular belt configuration having a thickness of 100 to 200 μm and may include carbon particles or like conductive material in nylon, polyester, polycarbonate, teflon or like synthetic resin so as to adjust resistivity to $10^{10}$ to $10^{11}$ Ω-cm. Useful examples of toner transporting member 5 are a resistive member configured as a circular belt 150 μm in thickness and having a resistivity of $1\times10^{10}$ Ω-cm and comprising carbon particles mixed in a nylon resin, and a resistive member configured as a circular belt 150 μm in thickness and having a resistivity of $5\times10^{10}$ Ω-cm and comprising carbon particles mixed in a teflon resin.

Using either of the aforesaid resistive members as the toner transporting member 5, when the conductive portion 17a of switching means 17 comes into contact with the interior surface of toner transporting member 5 in the vicinity of contact between said transporting member 5 and photoconductive drum 6, the electrical lines of force emanating from the latent image on the photoconductive drum 6 pass through the resistive member which comprises the toner transporting member 5 toward the aforesaid conductive portion 17a so as to rapidly increase the copy image density relative to the original document image density, thereby producing remarkable digital developing characteristics for γ characteristics so as to suitably reproduce the digital image.

On the other hand, when the switching means 17 is rotated so as to place the nonconductive portion 17b of switching means 17 in contact with the interior surface of the resistive member comprising the toner transporting member, a large resistance is produced in the circumferential direction of said toner transporting member 5 whereby the electrical lines of force emanating from the edge of the latent image formed on the surface of photoconductive drum 6 are turned back to the vicinity of said image edge to produce an edge effect.

In the second embodiment described above, a high density copy line image can be produced even when the original document line image has a low density, and a copy image density which corresponds to the density of the original document image can be obtained in the case of a solid image.

In the developing device of the second embodiment of the present invention as previously described, a toner transporting member, which supplies toner to the surface of an image carrying member having an electrostatic latent image formed thereon, may be constructed of an anisotropic conductive film or preferably a resistive member having a uniform conductivity, said toner transporting member being disposed in proximity to the image carrying member and at the position of said proximity is provided a switching means that switches between a conductive portion and a nonconductive portion and which makes contact with the interior surface of said toner transporting member on the side opposite to the image carrying member so as to control the electrical lines of force emanating from the latent image formed on said image carrying member.

In the developing device of the present invention, edge effect, tone and similar developing characteristics can be readily modified by switching between the conductive and nonconductive portions of a switching means disposed in contact with the interior surface of a toner transporting member based on input image data.

When the conductive portion of said switching means is in contact with the interior surface of the toner transporting member, remarkable digital developing characteristics for γ-characteristics are produced to suitably reproduce the digital image.

On the other hand, when the nonconductive portion of the switching means is in contact with the interior surface of the toner transporting member, a copy image density is produced which corresponds to the original document image density in the case of a solid image, and a higher image density is produced relative to an original document image having a low density in the case of a line image, so as to thereby reproduce suitable copier images.

The second embodiment of the developing device present invention achieves the same effectiveness as the first embodiment in relation to the elimination of residual charge retained by the toner transporting member, reducing manufacturing costs and making the device more compact.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device disposed adjacent to a rotatably arranged photoreceptor, which comprises:

a rotatably disposed actuating roller confronting said photoreceptor, said actuating roller being conductive; and a toner transporting member formed of a flexible member and having a peripheral length longer than that of said actuating roller and loosely mounted thereover in order to form a slack of the flexible member at least at a location confronting said photoreceptor so that said slack of the flexible member contacts with the surface of the photoreceptor while keeping a part of the flexible member substantially in contact with said actuating roller, said toner transporting member being constructed of electrically conductive film comprising insulated portions and electrically continuous portions which are electrically continuous in a thickness direction of said film.

2. A developing device as claimed in claim 1 wherein said insulated portions and electrically conductive portions forming said toner transporting member are provided alternatively.

3. A developing device as claimed in claim 1 wherein said electrically conductive portions are formed by a plurality of electrodes.

4. A developing device disposed adjacent to a rotatably arranged photoreceptor, which comprises:

a rotatably disposed actuating roller confronting said photoreceptor, said actuating roller being electrically conductive;

a toner transporting member formed of a flexible member having a peripheral length longer than that of said actuating roller and loosely mounted thereover, said toner transporting member being constructed of electrically conductive film alternatively comprising insulated portions and electrically continuous portions which are electrically continuous in a thickness direction of the film; and positioning means to position said flexible member partly into and out of contact with the surface of said photoreceptor, said positioning means forming a slack of the flexible member at a location confronting said photoreceptor so as to bring said slack into contact with the photoreceptor while keeping the remaining portion of the flexible member substantially in contact with said actuating roller.

5. A developing device disposed adjacent to a rotatably arranged photoreceptor, which comprises:

a rotatably disposed actuating roller confronting said photoreceptor; and a toner transporting member formed of a flexible member having a peripheral length longer than that of said actuating roller and loosely mounted thereover in order to encompass the actuating roller with a gap therebetween and to contact with the photoreceptor at a location confronting the photoreceptor, said toner transporting member being constructed of electrically conductive film comprising alternatively formed insulated portions and electrically continuous portions with latter formed by a plurality of electrodes so as to be electrically continuous in a thickness direction of the film.

6. A developing device disposed adjacently to a rotatably arranged photoreceptor, which comprises:

a rotatably disposed actuating roller confronting said photoreceptor;

a toner transporting member including a flexible member having a peripheral length longer than that of said actuating roller and loosely mounted thereover, said toner transporting member being constructed of electrically conductive film comprising alternatively formed insulated portions and electrically conductive portions;

positioning means for positioning said flexible member partly into and out of contact with the surface of said photoreceptor, said positioning means forming slack in the flexible member at a location confronting said photoreceptor so as to bring the slack into contact with the photoreceptor while keeping the remaining portion of the flexible member substantially in contact with said actuating roller;

switching means disposed to confront the toner transporting member at a position wherein the toner transporting member contacts the surface of the photoconductive member and including a conductive portion and a nonconductive portion which are selectively confronted; and control means for controlling said switching means according to original document density by selectively confronting said conductive and nonconductive portions.

7. A developing device disposed adjacently to a rotatably arranged photoreceptor, which comprises:

a rotatably disposed actuating roller confronting said photoreceptor;

a toner transporting member including a flexible member having a peripheral length longer than that of said actuating roller and loosely mounted thereover, said toner transporting member being constructed of electrically conductive film having a predetermined resistivity;

positioning means for positioning said flexible member partly into and out of contact with the surface of said photoreceptor, said positioning means forming slack in the flexible member at a location confronting said photoreceptor so as to bring the slack into contact with the photoreceptor while keeping the remaining portion of the flexible member substantially in contact with said actuating roller;

switching means disposed so as to confront the toner transporting member at a position wherein the toner transporting member contacts the surface of the photoconductive member and including a conductive portion and a nonconductive portion which are selectively confronted; and control means for controlling said switching means according to original document density by selectively confronting said conductive and nonconductive portions.

* * * * *